US007121081B2

(12) United States Patent
Wirkus et al.

(10) Patent No.: US 7,121,081 B2
(45) Date of Patent: Oct. 17, 2006

(54) EXHAUST GAS RECIRCULATION AFTERBURNER

(75) Inventors: John F. Wirkus, Saint Peters, MO (US); Robert F. Killion, Saint Charles, MO (US)

(73) Assignee: GSI Engine Management Group, St. Louis, MO (US)

( * ) Notice: Subject to any disclaimer, the term of this patent is extended or adjusted under 35 U.S.C. 154(b) by 0 days.

(21) Appl. No.: 10/723,195

(22) Filed: Nov. 26, 2003

(65) Prior Publication Data

US 2005/0109017 A1 May 26, 2005

(51) Int. Cl.
*F01N 3/00* (2006.01)

(52) U.S. Cl. ..... 60/282; 60/274; 60/278; 60/297; 123/568.11

(58) Field of Classification Search ..... 60/274, 60/278, 297, 311, 282; 123/568.11, 568.12; 29/896.6, 896.61, 896.62
See application file for complete search history.

(56) References Cited

U.S. PATENT DOCUMENTS 3,294,073 A 12/1966 Bressan
3,768,440 A * 10/1973 Doman et al. ..... 118/503
4,200,218 A * 4/1980 Koehler ..... 228/165
4,924,668 A 5/1990 Panten et al.
4,953,518 A 9/1990 Killion et al.
5,027,781 A 7/1991 Lewis
5,440,880 A * 8/1995 Ceynow et al. ..... 60/605.2
5,617,726 A * 4/1997 Sheridan et al. ..... 60/605.2
6,138,649 A * 10/2000 Khair et al. ..... 123/568.12
6,474,320 B1 11/2002 Modien
6,481,424 B1 * 11/2002 Bircann et al. ..... 123/568.11
6,530,366 B1 * 3/2003 Geiger et al. ..... 123/568.11
6,598,388 B1 * 7/2003 Lucas et al. ..... 60/311
6,742,335 B1 * 6/2004 Beck et al. ..... 60/605.2
2004/0006978 A1 * 1/2004 Beck et al. ..... 60/289
2004/0093866 A1 * 5/2004 Ishikawa ..... 60/605.2
2005/0086807 A1 * 4/2005 Richard et al. ..... 29/896.61

FOREIGN PATENT DOCUMENTS

JP 62083014 A * 4/1987
JP 07259654 A * 10/1995

* cited by examiner

*Primary Examiner*—Tu M. Nguyen
(74) *Attorney, Agent, or Firm*—Polster, Lieder, Woodruff & Lucchesi L.C.

(57) ABSTRACT

An embodiment of the invention includes an exhaust gas recirculation (EGR) valve, an intake pipe, and an afterburner. As the intake valve communicates an exhaust gas stream to an EGR valve, an afterburner affixed to an inside wall of the intake pipe captures and burns large particles contained in the exhaust gas stream to prevent obstruction of the EGR valve.

28 Claims, 1 Drawing Sheet

EXHAUST GAS RECIRCULATION AFTERBURNER

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The reduction of vehicle gas emissions is a common goal in the design of modern motor vehicles. A popular device used to reduce vehicle emissions is the exhaust gas recirculation valve or EGR valve. EGR valves operate by returning a part of the engine's exhaust to the engine intake for reintroduction into the combustion cycle. By returning the exhaust to the engine's combustion cycle, the combustion temperature is lowered, thus reducing the formation of nitrogen oxides, compounds that are implicated in the formation of photochemical smog.

Although EGR valves are effective at reducing undesirable gas emissions, large solid particles, predominantly carbon particles, in the exhaust can cause the valve to stick open or closed. When the valve sticks open, it produces a vacuum leak in the engine, causing drivability problems with the engine, such as stalling at idle, and in severe cases can cause the car's power brakes to fail. When the valve sticks closed, combustion temperature is raised, increasing pollutants and sometimes causing spark knock and engine damage. As a result, the obstructed EGR must be removed for cleaning or replaced. Even worse, the EGR valve can be obstructed again and again, resulting in recurring maintenance problems.

There have been some attempts to prevent obstructing and clogging of the EGR valves with various types of filters. For example, U.S. Pat. No. 5,027,781 discloses a stainless steel filter affixed to a gasket to provide a barrier to large carbon particles in the exhaust gas. However, these filters eventually are obstructed and clogged with large carbon particles as well.

BRIEF SUMMARY OF THE INVENTION

Briefly stated, the present invention reduces harmful carbon particles in an internal combustion engine exhaust system by positioning an afterburner in a passage in the exhaust system to burn the particles. Preferably, the afterburner is a screen affixed to an intake pipe located upstream of an exhaust gas recirculation valve. The screen captures and burns particles contained in an exhaust gas, which are of a size large enough to obstruct the exhaust gas recirculation valve. The afterburner is preferably in the form of a mesh screen.

The foregoing and other features and advantages of the invention as well as embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
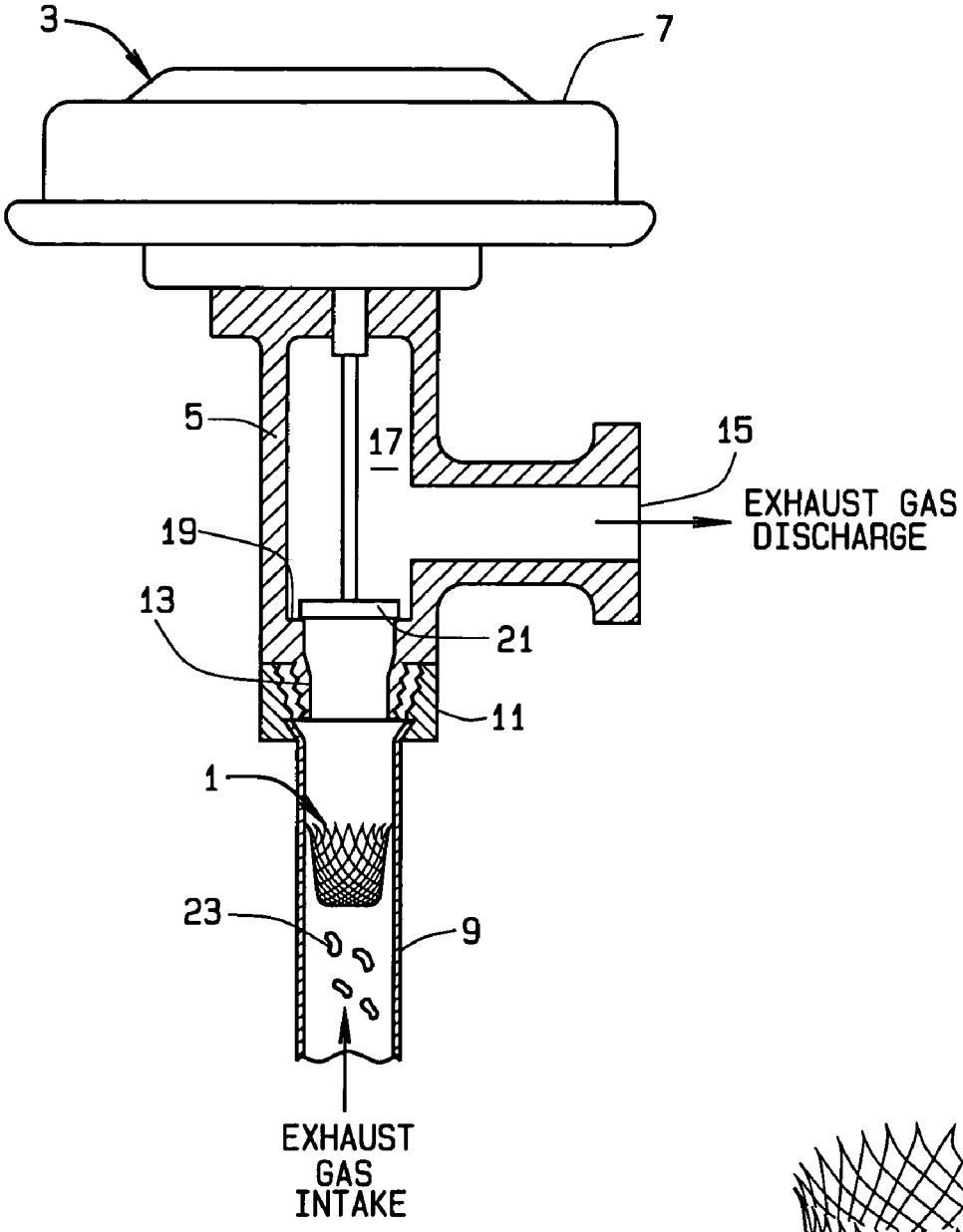
FIG. 1 is a cross-sectional view of an embodiment of an afterburner and an exhaust gas recirculation valve.
Figure 2:
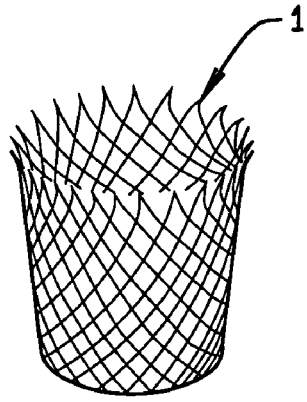
FIG. 2 is a perspective view of an embodiment of an afterburner.

As shown in FIG. 1, an embodiment of the invention includes an exhaust gas recirculation or EGR valve 3, an intake pipe 9, a nut 11, and an afterburner 1. The EGR valve 3 includes a lower housing 5 and an upper housing 7. The lower housing 5 defines an externally threaded intake orifice 13 for receiving an exhaust gas stream, a discharge orifice 15 for discharging the exhaust gas stream into the engine intake manifold, a cavity 17 for communicating the exhaust gas stream from the intake orifice 13 to the discharge orifice 15, and a seat 19 for receiving a pintle 21.

The upper housing 7 accommodates a control device of the EGR valve 3. In the embodiment shown in FIG. 1, the control device is a back pressure transducer, such as the one disclosed in U.S. Pat. No. 4,953,518 hereby incorporated by reference, which includes a pintle 21. The upper housing attaches to the lower housing 5 so that the pintle 21 moves from a raised position to a lowered position within the cavity 17. In the raised position, the exhaust gas stream enters the intake orifice 13, passes through the cavity 17, and discharges from the discharge orifice 15 to return to the combustion cycle. In the lowered position, the pintle 21 seats on the seat 19, and no exhaust gas stream enters the intake orifice 13. The control device cycles between the raised and lowered position depending on the amount of exhaust gas required by the combustion cycle. The amount of exhaust gas required by the combustion cycle and the timing of the cycle varies by calibration and is controlled by various factors such as engine speed, altitude, engine vacuum, exhaust system backpressure, coolant temperature and throttle angle depending on the calibration.

The intake pipe 9 is a flanged pipe or tube that mates with the intake orifice 13 of the lower housing 5. The nut 11 fits over the intake pipe and couples with the externally threaded intake orifice 13 so that the intake pipe 9 seats against the intake orifice 13. In this position, the intake pipe 9 communicates the exhaust gas stream to the EGR valve 3.

The afterburner 1 is a thimble-shaped screen which is affixed to an inside wall of the intake pipe 9 by an interference fit. The screen has an outwardly flared open end which, when the afterburner 1 is pushed down into an open end of the intake pipe 9, engages the interior of the pipe and prevents the afterburner from moving in the pipe 9 during normal operation of the engine system. The preferred afterburner 1 can be removed by the use of a hook which engages the mesh of the afterburner 1 and allows it to be pulled out of the intake pipe 9. The afterburner can be affixed anywhere within the intake pipe 9, or any other pipe in series with the EGR valve 3, as long as it is upstream of the EGR valve 3. For the purposes of this description, a screen is defined as a mesh-like device used to separate larger particles from smaller ones. The afterburner 1 is preferably made from a material with a high thermal capacity and conductivity. Stainless steel has been found to be suitable, although it is believed that the material is not critical so long as it will withstand a temperature of about 1300° F. and will hold burning carbon particles without damage to the material. To be effective, the afterburner 1 should have a mesh size that will capture large particles 23 while still allowing smaller particles to pass through. In general, a large particle is of any size particle that is large enough to obstruct the EGR valve 3 and smaller particles are any particles small enough to pass through the EGR valve 3 without causing an obstruction. In the preferred embodiment of FIG. 1, the afterburner 1 is formed as a thimble from a 16 mesh 304 stainless steel (melting point in excess of 2500° F.), having a wire diameter of 0.018", a 0.045 opening width, with a 50.7% open area. In other embodiments, the mesh size may preferably range from 5 mesh to 40 mesh.

In operation, the control device moves the pintle 21 to a raised position allowing the exhaust gas stream to flow through the intake pipe 9. As the exhaust gas stream flows through the intake pipe 9, it heats the afterburner 1 to a temperature high enough to burn the large particles 23 entrained in the exhaust gas stream. A typical exhaust gas stream can have a temperature range anywhere from ambient to 1300° F. and carbon particles in the exhaust gas stream will burn at a temperature of about 900° F. However, other particles may have other burn temperatures. The afterburner 1 captures large particles contained in an exhaust gas stream and burns the captured particles using conductive heat. When the exhaust gas stream is at a temperature of at least 900° F. and the EGR valve 3 is open, the exhaust gas stream continuously heats the afterburner 1 so that the afterburner 1 continuously burns the large carbon particles 23 it captures.

According to the laws of physics, the afterburner 1 can only reach a temperature as high as the exhaust gas stream. However, the afterburner 1 will burn the large particles 23 while the exhaust gas stream will not burn the large particles 23. Although the theory of operation of the afterburner 1 is not an essential part of the invention, it is believed that the reason the afterburner 1 burns the particles which are not normally burned in the exhaust stream is that the particles are held against the hot afterburner for an extended period while oxygen in the exhaust stream, amounting to at least one or two percent of the exhaust gas, passes over the particle. This is due to the difference between convective heat transfer and conductive heat transfer. Heat transfer from the exhaust gas stream to the large particles 23 is convective heat transfer, a relatively slow method of heat transfer. However, heat transfer from the afterburner to the large particles 23 is conductive heat transfer, a relatively fast method of heat transfer. As a result, the convective heat transfer of the gas stream is too slow to burn the large particles 23 by the time they reach the EGR valve. However, the afterburner 1 captures the large particles 23 and burns them off faster by using conductive heat transfer.

It is also important to note that the afterburner is not connected to any heat sinks, such as a gasket, that would lower the temperature of the afterburner 1 and prevent effective burning of the large particles 23. Otherwise, the afterburner could become clogged. It has remarkably been found that the afterburner 1 remains clean and protects the EGR valve even after extended use in systems which have previously caused the EGR valve to stick open or closed after relatively short time periods.

Changes can be made in the above constructions without departing from the scope of the invention, it is intended that all matter contained in the above description or shown in the accompanying drawings shall be interpreted as illustrative and not in a limiting sense. For example, while the embodiment of FIG. 1 discloses a vacuum type EGR valve, there are many types of EGR valves known in the art, both electrical and mechanical. Any type of EGR valve may be substituted for the EGR valve shown in FIG. 1, such as a ported EGR valve, an electronic EGR valve, or a valve and transducer assembly EGR valve. In addition, while the afterburner 1 is illustratively and preferably thimble-shaped, it may be any appropriate shape, such as disc-shaped. Although the afterburner 1 is preferably held in the intake pipe by friction, it could if desired by welded or otherwise secured. Although the afterburner is preferably inserted into the outlet end of an intake pipe of the EGR valve, in accordance with other embodiments of the invention it may be located in any part of an internal combustion exhaust system where it is effective to capture particles for a sufficient period to burn them. These variations are merely illustrative.

What is claimed is:

1. A method of afterburning large particles in an exhaust gas stream of an internal combustion engine, the exhaust stream comprising at least one molar percent oxygen, the method comprising pushing a screen into a pipe of an exhaust system of the engine next to an exhaust manifold, which is heated by the exhaust gas stream to a temperature of at least 900° F., and holding the screen in position by friction.

2. The method of claim 1 wherein the screen has an outwardly flared open end which, when the screen is pushed down into an open end of the pipe, engages the interior of the pipe and prevents the screen from moving in the pipe during normal operation of the system.

3. An afterburner for an internal combustion engine of a motor vehicle, the afterburner comprising:

a screen without a catalyst affixed to an intake pipe by interference fit and located upstream of an exhaust gas recirculation valve, wherein the screen captures and burns particles contained in an exhaust gas stream which are a size large enough to obstruct the exhaust gas recirculation valve;

wherein the exhaust gas stream heats the screen to a temperature sufficient to burn the particles.

4. An afterburner as in claim 3, wherein the screen is thimble-shaped.

5. An afterburner as in claim 3, wherein the screen has a mesh size of about 12 to 20.

6. An after burner as in claim 3, wherein the screen has a minimum size of 5 mesh.

7. An afterburner as in claim 3, wherein the screen has a maximum side of 40 mesh.

8. An afterburner as in claim 3, wherein the screen is affixed to an intake pipe and positioned adjacent to an exhaust manifold.

9. An afterburner as in claim 3, wherein the screen is made from a material with a high thermal conductivity.

10. An afterburner as in claim 9, wherein the screen is made from stainless steel.

11. An afterburner for an internal combustion engine of a motor vehicle, the afterburner comprising:

a screen without a catalyst affixed to an intake pipe and located upstream of an exhaust gas recirculation valve, the screen having an open end with an outer diameter that is larger than the inner diameter of the intake pipe, the screen being capable of capturing and burning particles contained in an exhaust gas stream which are a size large enough to obstruct the exhaust gas recirculation valve, the screen being capable of being heated by the exhaust gas stream to a temperature sufficient to burn the particles.

12. An exhaust gas recirculation valve system for a motor vehicle comprising:

an exhaust gas recirculation valve;

an intake pipe coupled to an intake orifice of the exhaust gas recirculation valve;

a screen located upstream of the exhaust gas recirculation valve, the screen being affixed to the intake pipe solely with an interference fit; and wherein the screen has an outwardly flared open end which, when the screen is pushed down into an open end of the intake pipe, engages the interior of the pipe and prevents the screen from moving in the pipe during normal operation of the system.

13. An afterburner for an internal combustion engine of a motor vehicle, the afterburner comprising:

a screen without a catalyst affixed to an intake pipe by interference fit and located upstream of an exhaust gas recirculation valve, wherein the screen captures and burns particles contained in an exhaust gas stream which are a size large enough to obstruct the exhaust gas recirculation valve;

wherein the exhaust gas stream continuously heats the screen to a temperature sufficient to burn the particles while the exhaust gas stream is at least 900° F.

14. An afterburner as in claim 13, wherein the screen is thimble-shaped.

15. An afterburner as in claim 13, wherein the screen has a mesh size of about 12 to 20.

16. An afterburner as in claim 13, wherein the screen has a minimum size of 5 mesh.

17. An afterburner as in claim 13, wherein the screen has a maximum size of 40 mesh.

18. An afterburner as in claim 13, wherein the screen is made from a material with a high thermal conductivity.

19. An afterburner as in claim 13, wherein the screen is made from stainless steel.

20. An afterburner as in claim 13, wherein the screen is affixed to an intake pipe and positioned adjacent to an exhaust manifold.

21. An exhaust gas recirculation valve system for a motor vehicle comprising:

an exhaust gas recirculation valve;

an intake pipe coupled to an intake orifice of the exhaust gas recirculation valve;

a screen affixed to the intake pipe by interference fit and positioned adjacent to an exhaust gas manifold, so that the screen captures and burns particles contained in an exhaust gas which are a size large enough to obstruct the exhaust gas recirculation valve;

wherein the exhaust gas stream heats the screen to a temperature sufficient to burn the particles.

22. An exhaust gas recirculation valve system for a motor vehicle as in claim 21, wherein the exhaust gas recirculation valve is an integral backpressure type valve.

23. An exhaust gas recirculation valve system for a motor vehicle as in claim 21, wherein the exhaust gas recirculation valve is a ported type valve.

24. An exhaust gas recirculation valve system for a motor vehicle as in claim 21, wherein the exhaust gas recirculation valve is an electronic type valve.

25. An exhaust gas recirculation valve system for a motor vehicle as in claim 21, wherein the exhaust gas recirculation valve is a valve and transducer type valve.

26. An exhaust gas recirculation valve system as in claim 21, wherein the screen is thimble-shaped.

27. An exhaust gas recirculation valve system as in claim 21, wherein the screen is made from a material with a high thermal conductivity.

28. An exhaust gas recirculation valve system as in claim 27, wherein the screen is made from stainless steel.

* * * * *

UNITED STATES PATENT AND TRADEMARK OFFICE

CERTIFICATE OF CORRECTION

PATENT NO. : 7,121,081 B2
APPLICATION NO. : 10/723195
DATED : October 17, 2006
INVENTOR(S) : John F. Wirkus and Robert F. Killion It is certified that error appears in the above-identified patent and that said Letters Patent is hereby corrected as shown below:

Col. 4, Line 55, Claim 6
Replace "after burner"
with -- afterburner --

Col. 4, Line 58, Claim 7
Replace "side"
with -- size --

Signed and Sealed this

Thirty-first Day of July, 2007

JON W. DUDAS
*Director of the United States Patent and Trademark Office*